United States Patent [19]

Dannert et al.

[11] Patent Number: 4,870,317

[45] Date of Patent: Sep. 26, 1989

[54] HIGH-PRESSURE DISCHARGE LAMP HAVING A THERMAL INSULATING MEMBER

[75] Inventors: Horst Dannert, Aachen; Hans-Peter Stormberg, Stolberg, both of Fed. Rep. of Germany

[73] Assignee: U.S. Philips Corporation, New York, N.Y.

[21] Appl. No.: 238,688

[22] Filed: Aug. 30, 1988

[30] Foreign Application Priority Data

Sep. 2, 1987 [DE] Fed. Rep. of Germany ..... 3729305

[51] Int. Cl.[4] ..... H01J 61/34

[52] U.S. Cl. ..... 313/25; 313/42; 313/43

[58] Field of Search ..... 313/25, 27, 39, 42, 313/43, 47

[56] References Cited

U.S. PATENT DOCUMENTS 2,562,887 8/1951 Beese ..... 313/25 X
3,333,132 7/1967 Edris et al. ..... 313/47 X
4,316,124 2/1982 Verwimp et al. ..... 315/205
4,479,071 10/1984 T'Jampens et al. ..... 313/42 X
4,644,216 2/1987 Schafer et al. ..... 313/25

FOREIGN PATENT DOCUMENTS 0165701 12/1985 European Pat. Off. .
481320 3/1938 United Kingdom .

OTHER PUBLICATIONS

Journal of Non-Crystalline Solids, 82 (1986), pp. 265–270, Amsterdam.

*Primary Examiner*—Donald J. Yusko
*Assistant Examiner*—Sandra L. O'Shea
*Attorney, Agent, or Firm*—Brian J. Wieghaus

[57] ABSTRACT

In a high-pressure gas discharge lamp having a discharge vessel containing an ionizable gas filling, consisting of translucent material and surrounded by a translucent outer envelope, which is adjoined at an end thereof by a lamp cap, the space between the discharge vessel and the said end of the outer envelope accomodates a thermally insulating porous translucent element consisting of a microporous aerogel.

22 Claims, 2 Drawing Sheets

HIGH-PRESSURE DISCHARGE LAMP HAVING A THERMAL INSULATING MEMBER

BACKGROUND OF THE INVENTION

The invention relates to a high-pressure discharge lamp comprising a discharge vessel, which contains an ionizable gas filling, consists of translucent material and is mounted within a translucent outer envelope, which is adjoined at an end thereof by a lamp base, a heat-insulating porous translucent member being arranged between the discharge vessel and the outer envelope. Such a lamp is known from GB PS 481320.

In high-pressure discharge lamps, for example in sodium, mercury or metal halide high-pressure discharge lamps, there is, especially with the vertical operating position in which the lamp base points upwards, the problem of overheating of the lamp base and of parts that may be contained therein. The lamp base may consist either only of the actual lamp cap or of the cap and an additional hollow body arranged between this cap and the outer envelope.

In newer high-pressure discharge lamps, it is known to accommodate an electronic ballast or ignition device in the lamp base (DE-OS 29 39 632, which corresponds to U.S. Pat. No. 4,316,124). Although in this case the lamp cap is covered by a heat-trapping plate, it is in immediate thermal contact with the outer envelope. As a result, the lamp cap can be heated to more than 150° C., which would lead to a destruction of the electronic elements located in the lamp cap. Moreover, in this case there is also need for a particular heat-resistant fitting.

U.S. Pat. No. 2,103,028 discloses a high-pressure discharge lamp, a cylindrical hollow glass member is arranged between the envelope and the cap, which member is to impede the heat transport to the cap because of its small wall thickness and great length. Such intermediate members make the lamp very long and mechanically unstable.

DE-OS 3416714, which corresponds to U.S. Pat. No. 4,644,216, discloses in high-pressure discharge lamp, in which the intermediate member of glass is folded as bellows, which requires, however, a complicated glass processing treatment.

However, the lamp base is heated not only by heat conduction from the outer envelope, but also by heat radiation, which is emitted by the discharge vessel and is absorbed by portions of the lamp base.

GB-PS 481320 discloses a gas discharge lamp, in which an insulating translucent material is present in the space between the discharge vessel and the outer envelope, which material may constitute, for example, a porous envelope of glass wool. Such a material leads to a strong scattering of the light originating from the discharge vessel, as a result of which the focusing of this light becomes more difficult. Therefore, such a material may have only a comparatively loose packing, as a result of which the trapping of heat is limited, however.

This also applies to a lamp arrangement known from EP 0 165 701 A1, in which a halogen incandescent lamp is arranged in an outer envelope. A heat shield and a filling consisting of insulating glass wool are provided between the incandescent lamp and the lamp base.

SUMMARY OF THE INVENTION

The invention has for its object to provide a high-pressure gas discharge lamp in which heating by irradiation of the lamp cap is deminished to a great extent by simple means and without visible light being substantially absorbed or reflected.

According to the invention, this object is achieved in a high-pressure gas discharge lamp of the kind mentioned in the opening paragraph in that the thermally insulating member is arranged solely between the base end of the outer envelope and the discharge vessel, and consists of a microporous aerogel.

U.S. application Ser. No. 148,799 filed Jan. 27, 1988 discloses a discharge lamp in which the discharge vessel is surrounded or partly covered by a layer of microporous aerogel. However, it may be undesirable for the microporous aerogel to envelop the discharge vessel because its operating properties are influenced. Due to the microporous aerogel provided between the discharge vessel and the base end of the outer envelope the lamp base is not heated strongly during lamp operation. The microstructure of the microporous aerogel ensures a substantial reflection of the infrared radiation so that the penetration depth of this radiation is small. The infrared radiation is reflected to the bowl of the outer envelope or to the exterior.

A microporous aerogel consists of a cross-linked and open-pored solid body structure of low density (more than one order of magnitude lower than that of the non-porous solid material itself). The pores are smallter than the optical wave length and lie, for example, between 0.03 and 0.2 μm, preferably between 0.04 and 0.07 μm. Therefore, such an aerogel results in only a very small scattering of the light.

The microporous envelope of the discharge vessel may consist either of silicon dioxide aerogel or of aluminum oxide aerogel. Such aerogels are very heat-resistant. Their light absorption is negligibly small. (The manufacture of silicon dioxide aerogel is described, for example, in "Journal of Non-Crystalline Solids", 82 (1986), p. 265 to 270, Amsterdam).

According to a further embodiment of the high-pressure gas discharge lamp in accordance with the invention, the thermally insulating element of microporous aerogel is a coherent mass. Efficaciously, the thermally insulating element is then in the form of a thick disk, or cylindrical body.

Preferably, this thermally insulating element consists of two half disks, or half-cylinders, which are provided in the contact plane with recesses for receiving holding wires supporting the discharge vessel. Such an element consisting of two half disks can be arranged to surround the holding wires after the inner lamp construction has been assembled, after which the cylindrical part of the outer envelope is arranged like a bell over it and is fused with the inner lamp construction.

An improvement of the gas discharge lamp can be further attained in that the side of the thermally insulating member facing the discharge vessel is concave. In this case, the thermally insulating member acts as a reflector, which reflects the received infrared radiation back onto the discharge vessel.

According to another embodiment of the invention, the thermally insulating element can consist of aerogel particles, preferably of aerogel pellets.

These aerogel particles can be accomodated in an auxiliary container of translucent material approximately corresponding to the dimensions of the base end of the outer envelope.

However, the aerogel particles may alternatively be fed loosely into the said end of the outer envelope, kept enclosed by a plate of quartz glass. The quartz glass plate provided, for example, with corresponding bores is slipped, before the holding wires are secured to the discharge vessel, over these holding wires and can then be held in that the holding wires are welded to the connections of the discharge vessel.

BRIEF DESCRIPTION OF THE DRAWINGS

A few embodiments according to the invention will now be described more fully with reference to the drawing. In the drawing.

DESCRIPTION OF THE PREFERRED EMBODIMENTS

Figure 1:
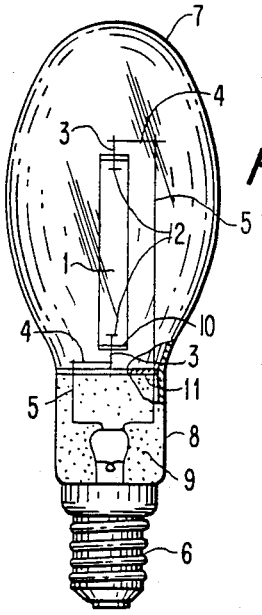
FIG. 1 is the side elevation of a high-pressure sodium vapour discharge lamp having an ellipsoidal outer envelope.

The high-pressure sodium vapour discharge lamp shown in FIG. 1 has a discharge vessel 1 of sintered aluminum oxide, in which two electrodes 2 are arranged, whose connection wires 3 are welded to intermediate parts 4, which are in turn connected to rigid current-supply conductors, or holding wires 5, which are connected to a lamp cap 6, which in this case solely constitutes the lamp base. The discharge vessel is surrounded by a glass outer envelope 7, which is at an end thereof adjoined by the lamp base.

The cylindrical end 8 of the outer envelope 7 on the side of the lamp base is filled with pellets 9 of silicium dioxide aerogel. Near the end 10 of the discharge vessel 1, the aerogel pellets 9 are covered by a plate 11 of quartz glass. For this purpose, before the holding wires 5 are secured to the intermediate parts 4, the quartz glass plate 11 provided with corresponding bores is slipped over these holding wires and is held on the holding wires 5 after the holding wires 5 have been welded to the intermediate parts 4. The discharge vessel assembly is then inserted into the outer envelope hanging downwards. The aerogel pellets are then added and the outer envelope is closed. Subsequently, the cap is cemented to the outer envelope.

Figure 2:
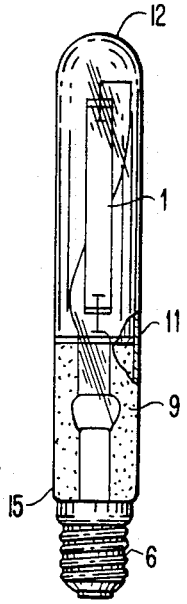
FIG. 2 is the side elevation of a high-pressure sodium vapour discharge lamp having a tubular outer envelope.

The high-pressure sodium vapour discharge lamp shown in FIG. 2 substantially corresponds to the lamp shown in FIG. 1, but has a tubular outer envelope 12 with an end 15 on the side of the lamp base 6.

Figure 3:
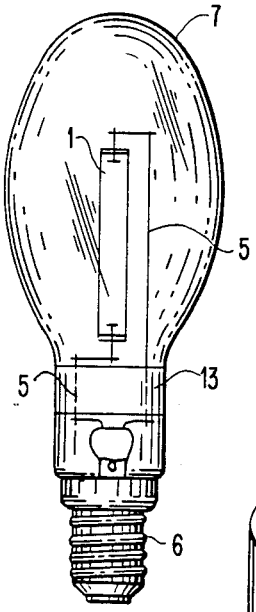
FIGS. 3 and 4 each are a side elevation of a high-pressure sodium vapour discharge lamp having an ellipsoidal and a tubular outer envelope, respectively.
Figure 4:
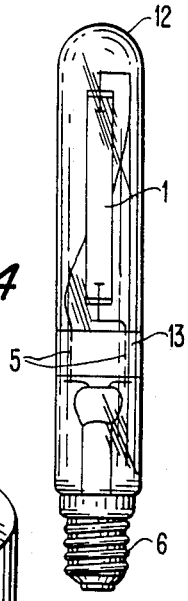
Figure 5:
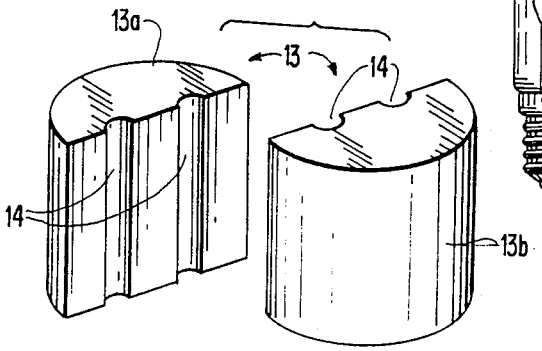
FIG. 5 is a perspective view of a thermally insulating member consisting of two half dishes and used in the lamps shown in FIGS. 3 and 4.

The high-pressure sodium vapour discharge lamps shown in FIGS. 3 and 4 correspond to the lamps shown in FIGS. 1 and 2, respectively, as to their lamp-technical construction. In these lamps, a disk-shaped thermally insulating member 13 of silicon dioxide aerogel is placed on the holding wires 5. This thermally insulating element 13 consists of two half disks, or half cylinders, 13*a*, 13*b* (FIG. 5), which are provided in their contact planes with longitudinally extending semi-cylindrical recesses 14 for receiving the holding wires 5 carrying the discharge vesse 1. The half disks 13*a* and 13*b* are arranged to surround the two holding wires 5 of the lamp and are held in position by the outer envelope after the lamp mount 1,5 is introduced into the outer envelope 7 and 12, respectively.

For this purpose, the outer diameter of the disk-shaped thermally insulating element 13 corresponds approximately to the inner diameter of the end 8 and 15, respectively, of the outer envelope 7 and 12, respectively, on the side of the lamp base 6.

Figure 6:
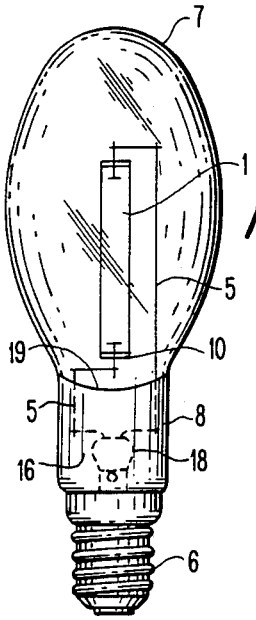
FIGS. 6 and 7 are side elevations of high-pressure sodium discharge lamps having an ellipsoidal outer envelope and a tubular outer envelope, respectively.
Figure 7:
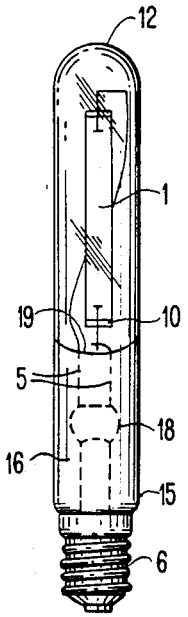
Figure 8:
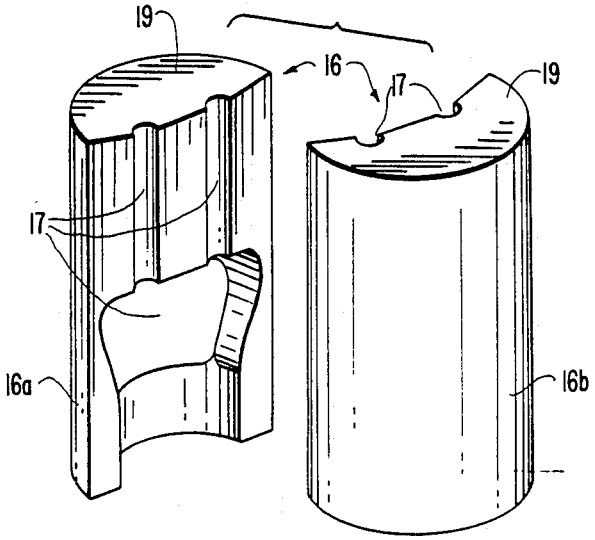
FIG. 8 is a perspective view of a thermally insulating element which consists of two half dishes and can be used in the lamp shown in FIG. 7.

The construction of the high-pressure sodium vapour discharge lamps shown in FIGS. 6 and 7 substantially corresponds to the construction of the lamps shown in FIGS. 1 and 2. A thermally insulating element 16 consisting of two half disks 16*a* and 16*b* and made of silicon dioxide aerogel is arranged between the ends 8 and 15, respectively, of the outer envelopes 7 and 12, respectively, and the end 10 of the lamp base of the discharge vessel 1. This thermally insulating element 16 practically fills the whole space of the outer envelope between the discharge vessel 1 and the cap 6. The two half disks 16*a* and 16*b* (FIG. 8) are provided in their intersection planes with recesses 17 for receiving the holding wires 5 carrying the discharge vessel 1 and an exhaust tube or lamp stem 18. The surface 19 of the member 16 facing the discharge vessel 1 is concave and acts as a reflector for the infrared radiation emitted by the discharge vessel 1.

Although the evacuation of the outer envelope is made somewhat more difficult by a thermally insulating element consisting of aerogel particles, it has been found in practice that also in these lamps a perfect evacuation is possible. The thermally insulating aerogel elements consisting of coherent half disks on the contrary substantially do not hinder the evacuation because sufficiently large passages between the envelope wall or the holding wires and the aerogel member are present. Moreover, a thin duct could be bored through the aerogel element without its thermally insulating effect being influenced.

In an embodiment, the effect of the thermally insulating aerogel was examined in a 30 W high-pressure sodium vapor discharge lamp shown in FIG. 1. A getter provided in the evacuated outer envelope guarantees that the pressure in the outer envelope is kept below $1\times10^{-5}$ mbar. The temperature was measured in all events at the point where the lamp base abuts the outer envelope. The temperature $T_1$ of the lamp shown in FIG. 1 having a thermally insulating aerogel member was compared with the temperatures of a comparison lamp ($T_2$), in which no thermally insulating measured were taken. The results are indicated in the following Table I.

TABLE I

| | With Aerogel member $T_1$(°C.) | Without Aerogel member $T_2$(°C.) |
|---|---|---|
| Lamp base above | 48 | 71 |
| Lamp base below | 43 | 60 |

The results show that the temperature at the lamp base is drastically decreased by a thermally insulating aerogel member. Tests on gas-filled outer envelopes have shown similar results. Since in that event during operation of the lamp the convection within the outer envelope determines the heat balance, a second test arrangement, in which solely a quartz plate is secured as convection shield to the said end of the discharge vessel, was also used for comparison. The temperatures of this lamp are designated under $T_3$ in the following table II.

TABLE II

| | with Aerogel member $T_1$(°C.) | without Aerogel member $T_2$(°C.) | with Quartz plate $T_3$(°C.) |
|---|---|---|---|
| Lamp base above | 59 | 127 | 94 |
| Lamp base below | 42 | 56 | 48 |

It appears from the tables that a particularly large decrease of the temperature of the lamp base is obtained if the lamp is operated in a position in which the lamp base is located on the upper side. The decrease of the temperature of the lamp base is now particularly desirable because in this operating position the lamp base temperatures normally strongly increase.

What is claimed is:

1. A high-pressure gas discharge lamp having a discharge vessel of translucent material containing an ionizable gas filling and mounted within a translucent outer envelope, which is adjoined at an end thereof by a lamp base, a thermally insulating porous translucent member being arranged between the discharge vessel and the outer envelope, characterized in that the thermally insulating member is arranged solely between the said end of the outer envelope and the discharge vessel, and consists of a microporous aerogel.

2. A lamp as claimed in claim 1, wherein the thermally insulating member consists of silicon dioxide aerogel.

3. A lamp as claimed in claim 1, wherein the thermally insulating member consists of aluminum oxide aerogel.

4. A lamp as claimed in claim 3, wherein the thermally insulating member is a coherent mass.

5. A lamp as claimed in claim 4, wherein the thermally insulating member is in the form of a disk.

6. A lamp as claimed in claim 5, further comprising rigid current-supply conductors connected to said discharge vessel, and said thermally insulating member consists of two half cylindrical bodies which are provided in their contact planes with recesses for receiving said current-supply conductors.

7. A lamp as claimed in claim 6, wherein the surface of the thermally insulating member facing the discharge vessel is concave.

8. A lamp as claimed in claim 1, wherein the thermally insulating member consists of aerogel particles.

9. A lamp as claimed in claim 8, further comprising an auxiliary container of translucent material for holding said aerogel particles, said container at least approximately corresponding to the dimensions of the outer envelope adjacent said base end.

10. A lamp as claimed in claim 8, further comprising a plate of quartz glass adjacent said discharge vessel, said aerogel particles being disposed in the end of the outer envelope between said base end and said plate.

11. A lamp as claimed in claim 2, wherein the thermally insulating member is a coherent mass.

12. A lamp as claimed in claim 11, further comprising rigid current-supply conductors connected to said discharge vessel, and said thermally insulating member consists of two half cylindrical bodies which are provided in their contact planes with recesses for receiving said current-supply conductors.

13. A lamp as claimed in claim 12, wherein the surface of the thermally insulating member facing the discharge vessel is concave.

14. A lamp as claimed in claim 1, wherein the thermally insulating member is a coherent mass.

15. A lamp as claimed in claim 14, further comprising rigid current-supply conductors connected to said discharge vessel, and said thermally insulating member consists of two half cylindrical bodies which are provided in their contact planes with recesses for receiving said current-supply conductors.

16. A lamp as claimed in claim 15, wherein the surface of the thermally insulating member facing the discharge vessel is concave.

17. A lamp as claimed in claim 2, wherein the thermally insulating member consists of aerogel particles.

18. A lamp as claimed in claim 17, further comprising an auxiliary container of translucent material for holding said aerogel particles, said container at least approximately corresponding to the dimensions of the outer envelope adjacent said base end.

19. A lamp as claimed in claim 17, further comprising a plate of quartz glass adjacent said discharge vessel, said the aerogel particles being disposed in the end of the outer envelope between said base end and said plate.

20. A lamp as claimed in claim 3, wherein the thermally insulating member consists of aerogel particles.

21. A lamp as claimed in claim 20, further comprising an auxiliary container of translucent material for holding said aerogel particles, said container at least approximately corresponding to the dimensions of the outer envelope adjacent said base end.

22. A lamp as claimed in claim 20, further comprising a plate of quartz glass adjacent said discharge vessel, said aerogel particles being disposed in the end of the outer envelope between said base end and said plate.

* * * * *